United States Patent [19]

Schulte

[11] Patent Number: 4,669,987

[45] Date of Patent: Jun. 2, 1987

[54] REMOTE STEERING ASSEMBLY KIT FOR OUTBOARD TROLLING MOTORS

[76] Inventor: Richard R. Schulte, 16424 S. Mayleon Dr., Plainfield, Ill. 60544

[21] Appl. No.: 852,275

[22] Filed: Apr. 15, 1986

Related U.S. Application Data

[63] Continuation of Ser. No. 775,284, Sep. 12, 1985, abandoned, which is a continuation of Ser. No. 607,539, May 7, 1984, abandoned.

[51] Int. Cl.[4] ..... B63H 21/17

[52] U.S. Cl. ..... 440/6; 440/58

[58] Field of Search ..... 440/6, 7, 58–60; 114/144 RE, 153; 403/344, 365

[56] References Cited

U.S. PATENT DOCUMENTS

| | | | |
|---|---|---|---|
| 653,313 | 7/1900 | Raifsnyder | 403/344 |
| 1,021,408 | 3/1912 | Haschbe | 440/6 |
| 2,804,838 | 9/1957 | Moser | 440/7 |
| 3,106,101 | 10/1963 | Harriman | 403/344 X |
| 3,598,947 | 8/1971 | Osborn | 440/7 |
| 3,906,887 | 9/1975 | Kappas | 440/6 |

*Primary Examiner*—Sherman D. Basinger

*Attorney, Agent, or Firm*—Ernest Kettelson

[57] ABSTRACT

A remote steering assembly kit for outboard trolling motors of the type having an elongated cylindrical drive shaft housing, a trolling motor at the top of the housing to drive a propeller at the bottom thereof, the cylindrical housing being pivotally mounted on a frame clamped to the stern of a boat. The remote steering assembly kit includes a mounting bracket which connects to the frame by the same pivot member which pivotally mounts the elongated drive shaft housing to the frame, a split ring coupling collar to secure around the elongated drive shaft housing for rotation thereof, the coupling collar being seated for rotation on the mounting bracket, a large diameter steering gear positioned coaxially with the elongated drive shaft housing and bolted to the coupling collar, a reversible electric motor with drive gear attached in mesh with the steering gear to rotate the steering gear, coupling collar and cylindrical drive shaft housing, in opposite directions thereby steering the boat, and a switch to operate the motor connected to the motor by conductors long enough to enable placing the switch at any desired remote location forwardly in the boat.

2 Claims, 13 Drawing Figures

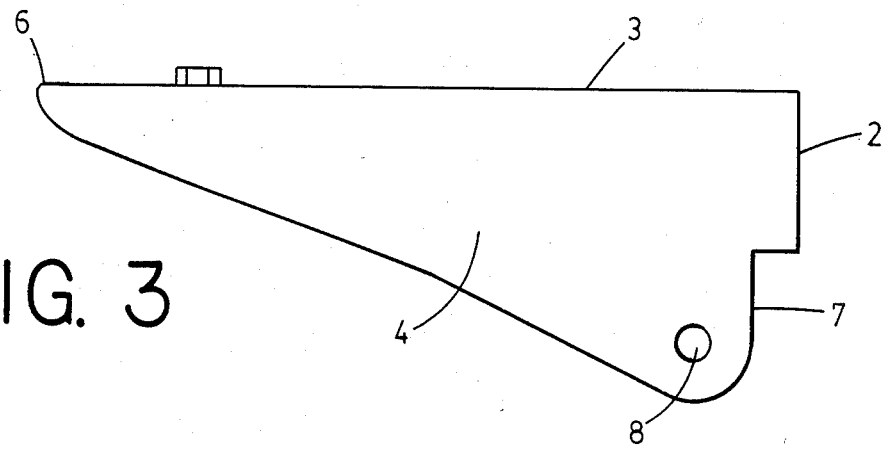
FIG. 3
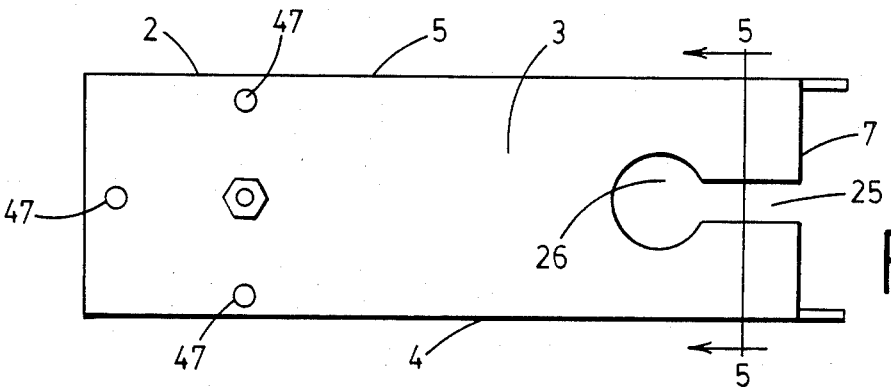
FIG. 4
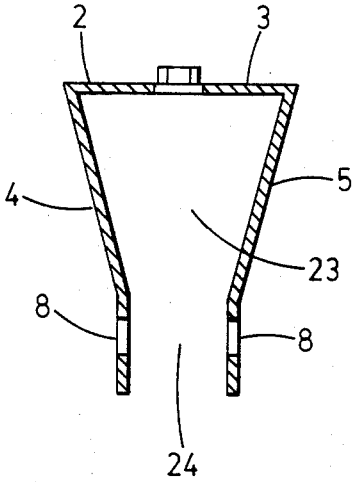
FIG. 5
FIG. 13
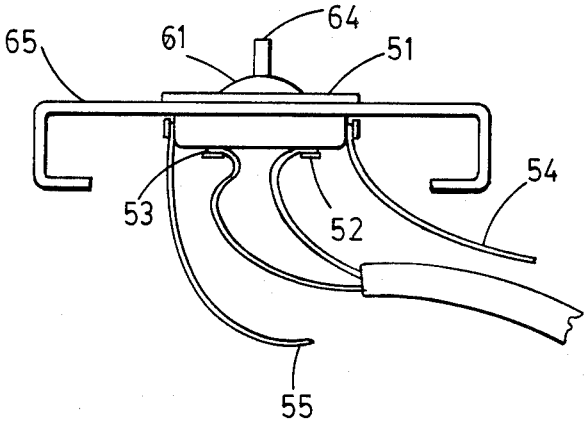

REMOTE STEERING ASSEMBLY KIT FOR OUTBOARD TROLLING MOTORS

This application is a continuation of prior application Ser. No. 775,284 filed Sept. 12, 1985, now abandoned, which in turn is a continuation of prior application Ser. No. 607,539 filed May 7, 1984, also now abandoned.

BACKGROUND OF THE INVENTION

This invention relates to the field of remote control steering devices to enable steering of outboard trolling motors at any desired location forwardly in the boat, preferably by the fisherman's foot so he can keep his hands on the fish pole and reel when he has a fish on the line. It relates particularly to kits comprising component parts by which existing trolling motors can be equipped with remote steering capability.

Various types of remote control steering devices are known to the prior art, but most of these require substantial modification to install on existing motors or they have to be bought already installed as part of the original equipment. Some examples of remote steering controls for watercraft in general include the foot controls shown in U.S. Pat. No. 4,311,108 to individually operate two separate motors on opposite sides of the pontoon barge and thus steer the craft that way; U.S. Pat. No. 4,262,618 discloses a mechanism for attaching a motor to the steering wheel of a boat equipped with that kind of a steering mechanism; U.S. Pat. No. 4,037,556 discloses a complex built-in control mechanism to steer an outboard motor by means of a foot pedal; U.S. Pat. 3,989,000 discloses a built-in steering motor for a trolling boat motor connected by belt means for operation of the steering mechanism; U.S. Pat. No. 3,811,394 discloses a control unit for automatic pilot steering of a boat. U.S. Pat. No. 3,613,624 discloses a steering system for boats using cables attached to the steering arm of an outboard motor; U.S. Pat. No. 3,598,947 discloses a trolling motor which has a steering motor built in as part of the original construction; U.S. Pat. No. 2,877,733 disloses another already built in steering and power control system for outboard motors.

There has not been available in the prior art a convenient kit assembly which would enable adding remote control capability to existing trolling motors at low cost, easy to install requiring no drilling, welding or other modification of the existing motor, and that is of durable construction.

The remote steering assembly kit in accordance with the present invention fills that need.

SUMMARY OF THE INVENTION

It is an object of the invention to provide a remote steering kit for outboard trolling motors that can be installed on existing trolling motors without modification of such existing motor.

It is an object of the invention to provide a remote steering kit for outboard trolling motors that can be installed on existing trolling motors by anyone with a minimum of effort and by use of readily available tools.

It is an object of the invention to provide a remote steering kit for outboard trolling motors comprising a mounting frame connectable to an existing bolt of the trolling motor, a coupling collar seated for rotation on the mounting frame and connected to rotate the elongated vertical drive shaft housing of the trolling motor, a steering gear bolted to the coupling collar having a radially extending slot to receive the drive shaft housing for positioning the steering gear coaxially with the drive shaft housing, and a steering motor having a drive gear in mesh with said steering gear to rotate said steering gear in both opposite directions of rotation, thereby rotating the vertical drive shaft housing of the trolling motor to which its propeller is connected at the bottom end and thus steering the boat.

BRIEF DESCRIPTION OF THE DRAWING

FIG. 3 is a side elevation view of the mounting bracket part of the remote steering assembly kit in accordance with this invention.

FIG. 4 is a plan view of the mounting bracket shown in FIG. 3.

FIG. 5 is a section view taken on line 5—5 of FIG. 4.

FIG. 13 is a side elevation view of the switch used in operating the invention described herein.

DESCRIPTION OF THE PREFERRED EMBODIMENT

Figure 1:
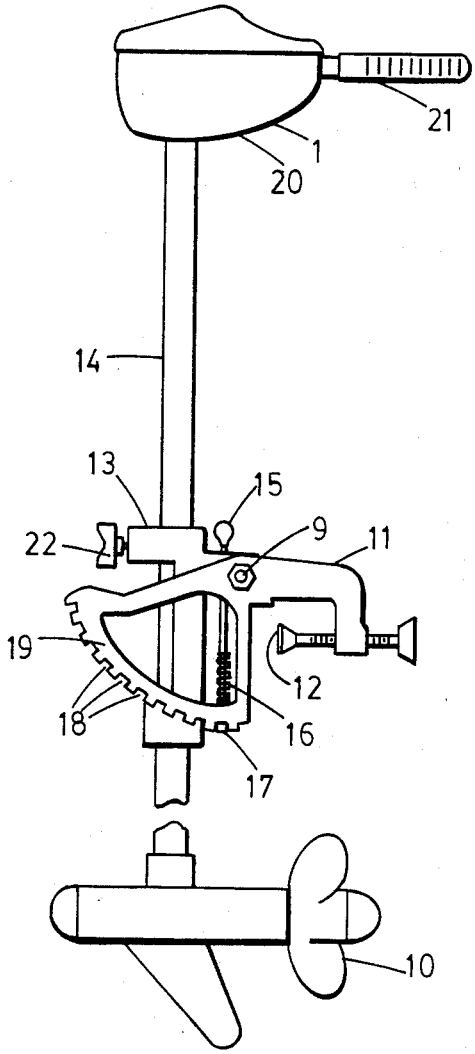
FIG. 1 is a side elevation view of a trolling motor of the type for which a remote steering assembly kit in accordance with the present invention may be used.
Figure 2:
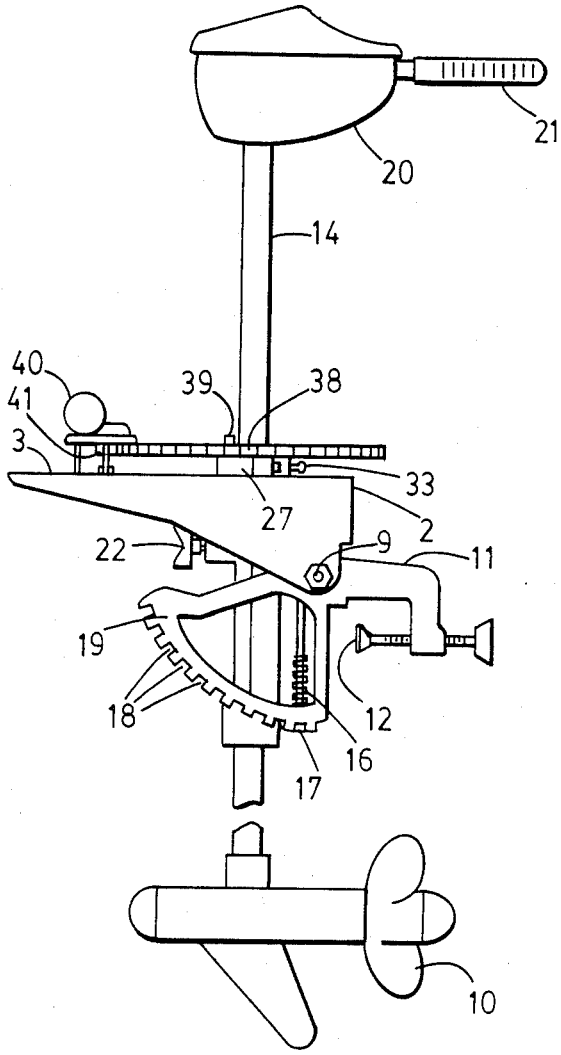
FIG. 2 is a side elevation view of the trolling motor of FIG. 1 shown with a remote steering assembly kit in accordance with this invention operably mounted thereon.
Figure 9:
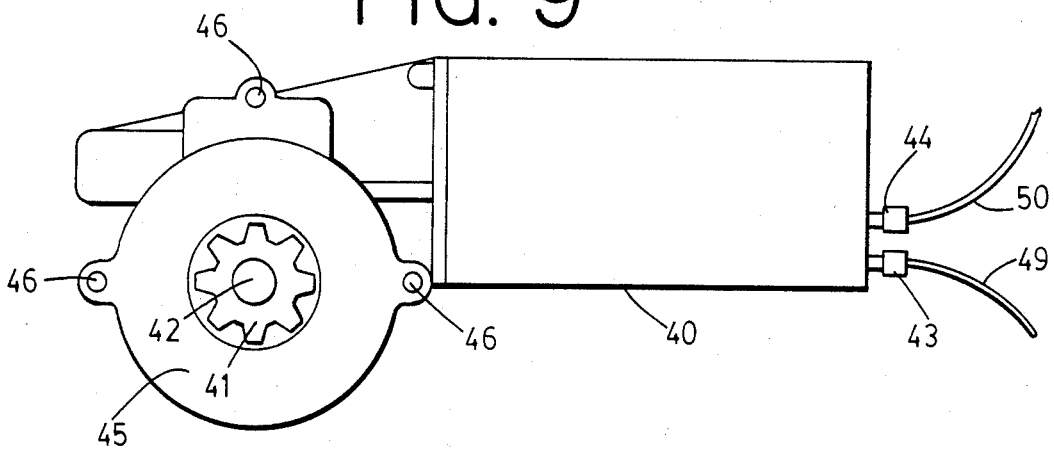
FIG. 9 is a plan view from the bottom of the drive gear part of the remote steering assembly kit in accordance with this invention and D. C. electric motor connected thereto.
Figure 6:
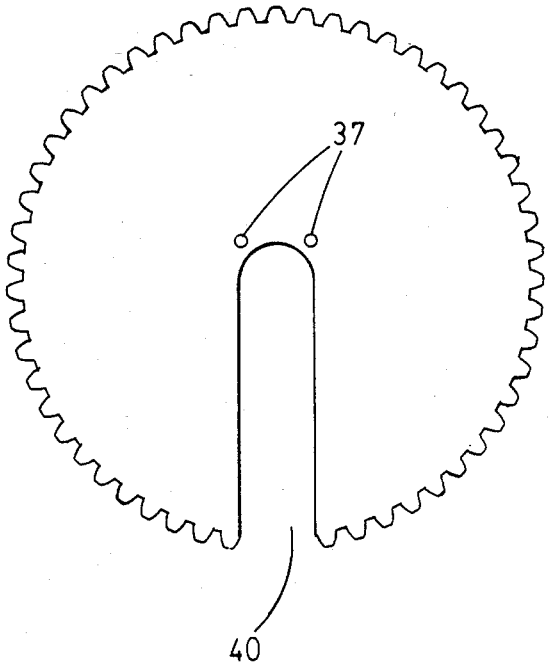
FIG. 6 is a plan view of the driven steering gear part of the remote steering assembly kit in accordance with this invention.
Figure 7:
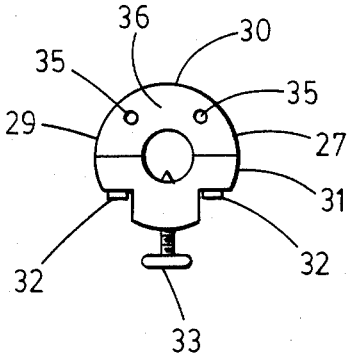
FIG. 7 is a plan view of the coupling collar part of the remote steering assembly kit in accordance with this invention.
Figure 8:
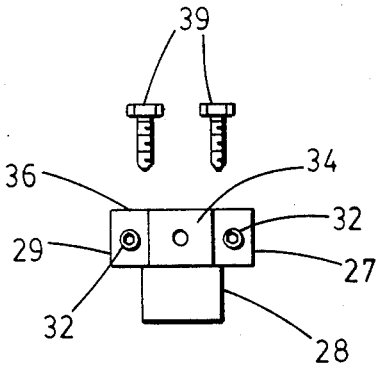
FIG. 8 is a side elevation view of the coupling collar shown in FIG. 7.
Figure 10:
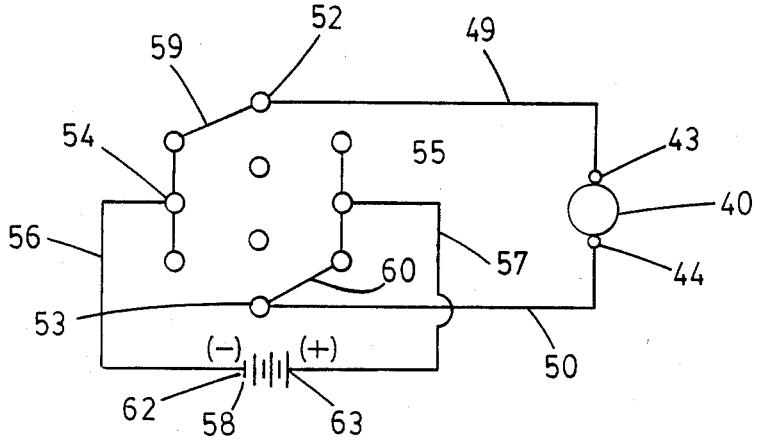
FIG. 10 is a schematic of the electric circuit in accordance with this invention, showing the circuit energized with the operating switch in a first position and the motor terminals having the polarity shown.
Figure 11:
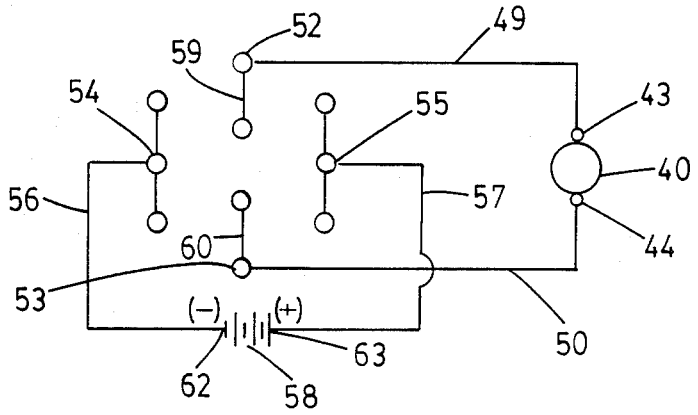
FIG. 11 is a schematic of the electric circuit in accordance with this invention, showing the circuit interrupted with the operating switch in a second position and no current flowing to the motor.
Figure 12:
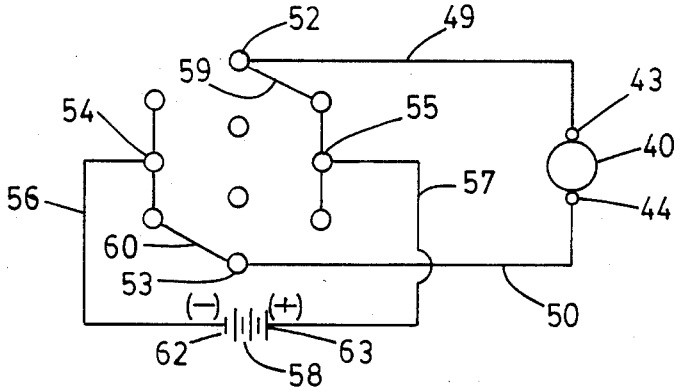
FIG. 12 is a schematic of the electric circuit in accordance with this invention, showing the circuit energized with the operating switch in a third position and the motor terminals having opposite polarity from that shown in FIG. 11.

A conventional outboard trolling motor 1 is illustrated in FIG. 1. The remote steering assembly kit in accordance with the present invention is readily adapted for use with such a trolling motor and most others, since they have comparable parts to which the remote steering assembly kit as described herein can be mounted for use.

The remote steering assembly kit includes a mounting bracket 2 having a horizontally extending base plate 3 and spaced apart depending side walls 4 and 5. The side walls 4 and 5 taper downwardly from the rear edge 6 to the forward edge 7 of the bracket 2. A pair of aligned apertures 8 are formed in the lower portion of the side walls 4 and 5 near the forward edge 7 to receive the pivot bolt 9, which is part of the original trolling motor 1 and on which it pivots to lift the propeller 10 from the water and to lower it into the water.

The original trolling motor 1 includes a boat mounting frame 11, having a clamp member 12 to clamp to the transom of the boat. The pivot bolt 9 extends transversely through the body portion of the mounting frame 11, and the pivotable sleeve member 13 which slidably and rotatably holds the elongated cylindrical drive shaft housing 14 of the trolling motor 1 is pivotably mounted on the pivot bolt 9. The original motor includes a latch release lever 15, normally biased upwardly into its latching position by a compression spring 16, to seat the latch bar 17 in one of the notches 18 of the rack portion 19 of the mounting frame 11. To lift the propeller 10 from the water, the latch release lever 15 is depressed which moves the latch bar 17 out of the lowermost notch 18, whereupon the pivotable sleeve member 13 and elongated drive shaft housing 14 can be pivoted on the pivot bolt 9 until the propeller 10 has been lifted from the water. The latch release lever 15 is then released allowing the latch bar 17 to seat in an adjacent notch 18 to hold the mechanism in that position with the propeller out of the water.

To complete the description of the trolling motor, the propeller 10 is rotated by a drive shaft which extends upwardly through the drive shaft housing 14 to a trolling motor in the motor housing 20 at the top of the drive shaft housing 14. Operation of the trolling motor is controlled by the operating lever 21. The depth of the propeller 10 in the water can be adjusted by loosening the mounting frame set screw 22 whereupon the cylindrical drive shaft housing 14 can be raised or lowered to a desired height, after which the set screw 22 is again tightened.

The mounting bracket 2 in accordance with this invention has an open front wall 23 for ready access to the latch release lever 15 when mounting bracket 2 has been mounted on the pivot bolt 9. The bottom wall 24 is also open and tapers upwardly toward the rear edge 6 where it meets the rear edge of the base plate 3. This permits ready access to the mounting frame set screw 22 of the original trolling motor assembly.

The base plate 3 of the mounting bracket 2 includes a slot 25 opening to the forward edge 7 wide enough to receive the cylindrical drive shaft housing 14 therethrough when the mounting bracket 2 has been pivotably mounted on pivot bolt 9 and pivoted upwardly to a position where the base plate 3 is substantially horizontal. The slot 25 opens inwardly to a circular aperture 26 of somewhat larger diameter than that of the cylindrical drive shaft housing 14 which is concentric and co-axial therewith.

A coupling collar 27 seats in the annular space formed between the cylindrical drive shaft housing 14 and the peripheral edge of the larger diameter aperture 26. The coupling collar 27 includes a lower annular ring 28 having an outer diameter corresponding to the diameter of the circular aperture 26 and an inner diameter corresponding to the outer diameter of the cylindrical drive shaft housing 14, and an upper annular portion 29 having a diameter larger than that of the circular aperture 26. Thus, when lower annular ring 28 of the collar 27 is seated in the annular space between the cylindrical drive shaft housing 14 and the peripheral circular edge of the aperture 26, the upper annular portion 29 rests against the base plate 3.

The coupling collar 27 is a split collar comprised of two semi-annular halves 30 and 31, which are separable to permit removal from the cylindrical drive shaft housing 14, and joinable to mount on such shaft housing. A pair of connecting screws 32, having recesses to receive an Allen wrench for rotation thereof, are provided to join and hold said two halves 30 and 31 together.

A steering assembly set screw 33 is threaded through the annular wall 34 of the upper annular portion 29 to bear against the cylindrical drive shaft housing 14 of the trolling motor 1, whereby such drive shaft housing 14 is rotated when the coupling collar 27 is rotated.

The rearward facing annular half 30 of the collar 27 includes a pair of threaded taps 35 opening to its upper surface 36, such taps 35 being in registration with a corresponding pair of apertures 37 in the relatively large diameter planar driven gear 38 which rests on top of the coupling collar 27. A pair of bolts 39 extend through the apertures 37 into the threaded taps 35 and are tightened to hold the driven gear securely to the coupling collar 27. The planar gear 38 is of relatively thin cross-section or thickness, as for example one-eighth of an inch thick.

The large diameter planar gear 38 includes a radially extending slot 40 opening to the peripheral wall of the gear 38, such slot 40 being wide enough to receive the cylindrical drive shaft housing 14 therein as the gear 38 is positioned over the coupling collar 27, coaxially therewith and coaxial also with the cylindrical drive shaft housing 14. Thus, when the driven gear 38 is rotated on its axis, it rotates coupling collar 27 to which it is bolted, and it also rotates the cylindrical drive shaft housing 14 which is fixedly secured to the coupling collar 27 by the steering assembly set screw 33.

A small D. C. electric motor 40 is mounted at the rear portion of the base plate 3 of mounting bracket 2 having a drive gear 41 mounted on its drive shaft 42, in mesh with the large diameter driven gear 38. Such motors may be of any conventional type known to the prior art and readily available. Such motor 40 is of the type that changes direction of rotation of the drive shaft 42 when polarity at its terminals 43 and 44 is reversed. As an example of a motor which may be used in this invention, the one illustrated in the drawing is made for original use to power the electrically operated windows of an automobile.

The motor 40 includes a gear housing 45 over its drive gear 41, such housing having three circumferentially spaced apart apertures 46 which are in registration with three corresponding apertures 47 through the base plate 3 of the mounting bracket 2 when the drive gear 41 is in mesh with driven gear 38. Three bolts 48 are received through the apertures 46 and 47 to bolt the motor 40 securely to the base plate 3 with its drive gear 41 in driving engagement with driven gear 38.

Electrical conductors 49 and 50 lead from respective motor terminals 43 and 44 to a reverse polarity switch 51, having output terminals 52 and 53 for connection to conductors 49 and 50 leading from the motor 40, and input terminals 54 and 55 for connection to conductors 56 and 57 leading from the battery 58. Movable contact arm 59 is connected to output terminal 52 and movable contact arm 60 is connected to output terminal 53. The movable contact arms 59 and 60 are movable by a switch operator 61 between a first position wherein contact arm 59 makes electrical contact with input terminal 54 leading from the negative terminal 62 of battery 58 and contact arm 60 makes electrical contact with input terminal 55 leading from the positive terminal 63 of battery 58; a second position wherein contact arms 59 and 60 move to positions between respective input terminals thereby interrupting the circuit; and a third position wherein contact arm 59 makes electrical contact with the positive input terminal 55 and contact arm 60 makes electrical contact with the negative input terminal 54. As can be seen from the schematic drawings illustrating these three positions, in the first position the polarity at motor terminal 43 is negative and at motor terminal 44 positive causing the motor 40 to rotate in one direction. In the second position, the circuit is interrupted and the motor 40 is stopped. In the third position, the polarity at motor terminal 43 is positive and at motor terminal 44 is negative causing the motor 40 to rotate in the opposite direction from that when the switch 51 is in the first position.

The conductors 49 and 50 leading from the motor 40 to the reverse polarity switch 51 are long enough to enable positioning the switch 51 at any desired forward position in the boat. The switch operator 61 as shown in the drawing includes an upwardly projecting arm 64 which is connected to move the movable contact arms 59 and 60 between the aforesaid first, second and third positions, and which is normally biased to the second or circuit interrupted position. The operator arm 64 at such time is in a substantially normal position relative to the base plate 65 of the switch 51. The arm 64 if pivotable in one direction to move the contact arms 59 and 60 to the first switch position whereby the electrical circuit is energized with motor terminal 43 being negative and motor terminal 44 being positive causing the motor 40 to rotate in one direction, and the arm 64 is pivotable in the opposite direction to move contact arms 59 and 60 to the third switch position whereby the circuit is also energized but with the polarity of motor terminals 43 and 44 reversed causing the motor 40 to rotate in the opposite direction. When the switch operator arm 64 is released it is automatically biased back to the second or circuit interrupted position causing the motor 40 to stop.

The switch 51 may be laid in the bottom of the boat and moved to the switch positions described by the fisherman's foot. When moved to the first switch position, the motor 40 rotates in one direction causing the driven gear 38 in mesh with the motor's drive gear 41 to rotate, moving with it the coupling collar 27 and the cylindrical dirve shaft housing 14 of the trolling motor 1 in the same direction of rotation. The propeller 10 is thus also rotated causing the boat to turn in one direction. When the fisherman moves the switch operator arm 64 in the opposite direction to the third switch position as described above, the motor 40 rotates in the opposite direction, in turn rotating driven gear 38, coupling collar 27, and cylindrical drive shaft housing 14 in the opposite direction causing the boat to turn in the opposite direction.

A significant feature of the remote steering assembly kit in accordance with this invention is the fact that it can be connected to existing trolling motors without modification. The component parts of the kit are the mounting bracket 2, the coupling collar 27, the large diameter driven gear 38, the electric motor 40 with attached drive gear 41, a battery 58 and the polarity reversing switch 51 which may be placed forward in the boat at any desired location. Attachment of these component parts which make up the kit is very simple as described and explained above, requiring only a few tools such as an adjustable end wrench and an Allen wrench and not requiring that any holes have to be drilled, parts welded or the like. The kit is essentially universal, and useable with any of the existing outboard trolling motors to provide remote steering from any forward position in the boat.

I claim:

1. A remote steering assembly kit for an outboard trolling motor of the type having an upwardly extending cylindrical drive shaft housing extending from a drive motor at the upper end to a propeller at the bottom end and being rotatable to steer the boat on which it is mounted, said kit comprising rotatable steering gear means for mounting on said cylindrical drive shaft housing coaxially therewith to rotate it in both opposite directions of rotation and thereby steer the boat, power drive gear means positioned to rotate said steering gear means in both opposite directions of rotation on command, and control means to direct said power drive gear means to rotate said steering gear means as desired in each opposite direction of rotation to steer the said boat to the right when rotated in one direction and to the left when rotated in the opposite direction of rotation, said control means being movable to a location in said boat remote from said trolling motor for remote steering control of said boat, wherein said power drive gear means includes an electric motor, an electric power source, a drive shaft on said motor, a drive gear on said drive shaft, said rotatable steering gear means includes a planar gear member, an annular collar member secured to said planar gear member, a mounting frame to mount said motor in fixed relationship to said planar gear member with its drive gear meshed therewith, wherein said mounting frame includes a base plate, said motor being mounted on said base plate, said base plate including a pair of spaced apart elongated side edges, a first end edge extending laterally across one end thereof between said two side edges, a second end edge extending laterally across the opposite end thereof between said two side edges, a slot extending inwardly of said base plate and opening to said first end edge thereof, said slot having a width corresponding to the outer diameter of said cylindrical drive shaft housing to receive the same therein, a circular aperture inwardly of said base plate, said slot opening to said circular aperture at its opposite end, said annular collar member includes a lower circular ring portion having a circular annular wall surrounding a cylindrical bore through said collar member, said lower circular ring portion having an outer circumference of a first dimension, said circular aperture have a circumference corresponding to said first dimension to receive said lower circular ring portion of said annular collar member therein, said annular collar member having an upper annular portion of larger peripheral dimension surrounding said circular bore through said collar member, said upper annular portion of large peripheral dimension resting on said base plate, said cylindrical drive shaft housing being received through said circular bore through said collar member.

2. A remote steering assembly kit as set forth in claim 1, wherein said outboard trolling motor of the type for which said remote steering assembly kit is provided includes a trolling motor hinge member to pivot said cylindrical drive shaft housing between a position wherein said propeller extends into the water and a position wherein it is lifted out of the water, said mounting frame of said remote steering assembly kit including a pair of spaced apart downwardly extending side walls, each of said side walls including an aperture therein in registration with each other, said trolling motor hinge member extending through said apertures to affix said mounting frame to said trolling motor.

* * * * *